US005230514A

United States Patent [19]

Frain

[11] Patent Number: 5,230,514

[45] Date of Patent: Jul. 27, 1993

[54] ELECTRIC BINGO GAME CARD

[76] Inventor: John J. Frain, 40 Kildare Walk, Breezy Point, N.Y. 11697

[21] Appl. No.: 926,649

[22] Filed: Aug. 10, 1992

[51] Int. Cl.[5] ..... A63F 3/06

[52] U.S. Cl. ..... 273/237; 273/269

[58] Field of Search ..... 273/237, 269

[56] References Cited

U.S. PATENT DOCUMENTS

| | | | |
|---|---|---|---|
| 2,760,619 | 8/1956 | Peak | 273/237 |
| 3,671,041 | 6/1972 | Taylor et al. | 273/237 |
| 4,212,468 | 7/1980 | Knott | 273/240 |
| 4,228,596 | 10/1980 | Daniel | 273/237 |
| 4,365,810 | 12/1982 | Richardson | 273/237 |
| 4,378,940 | 4/1983 | Gluz et al. | 273/237 |
| 4,455,025 | 6/1984 | Itkis | 273/237 |
| 4,475,157 | 10/1984 | Bolan | 364/410 |
| 4,624,462 | 11/1986 | Itkis | 273/237 |
| 4,838,557 | 6/1989 | Floyhar | 273/237 |
| 4,856,787 | 8/1989 | Itkis | 273/237 |

FOREIGN PATENT DOCUMENTS

| | | | |
|---|---|---|---|
| WO86/04826 | 8/1986 | World Int. Prop. O. | 273/269 |

*Primary Examiner*—Benjamin H. Layno

*Attorney, Agent, or Firm*—Watson, Cole, Grindle & Watson

[57] ABSTRACT

An electric bingo game card is disclosed. A first group of selectors are manually operable for producing an indication of a called number in the game. A second group of selectors are operable for selecting winning combinations for variations of the game. A logic circuit responsive to the first group of selectors and to the second group of selectors produces a corresponding output when predetermined ones of the first group of selectors and the second group of selectors indicate a winning combination of selected numbers for the variation.

15 Claims, 3 Drawing Sheets

Fig. 4.
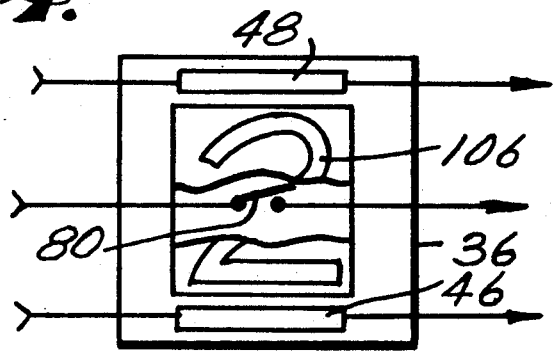
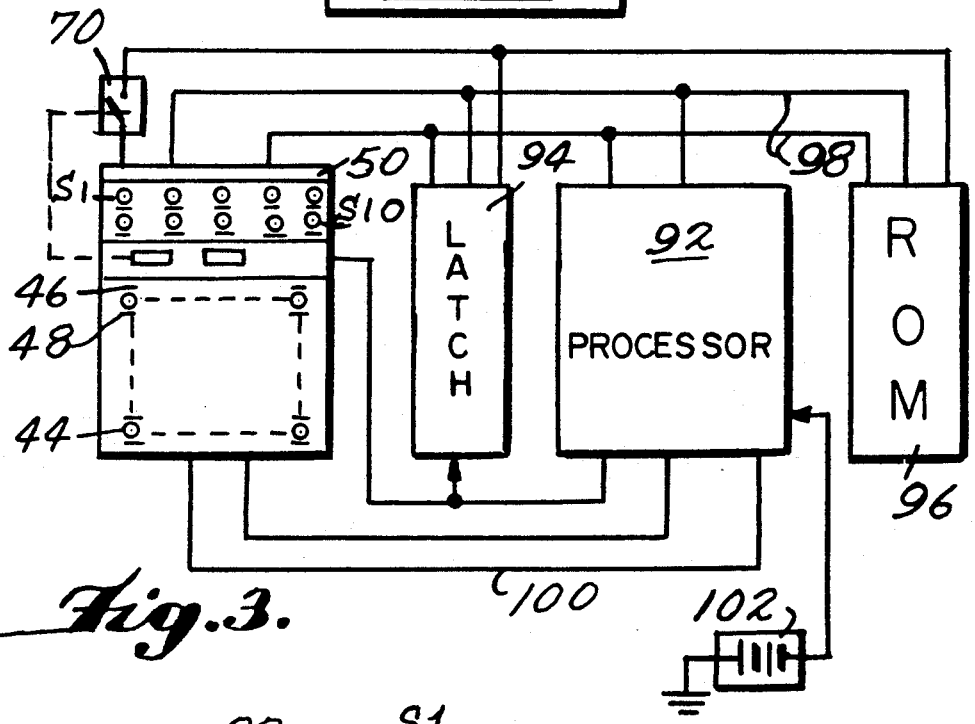
Fig. 3.
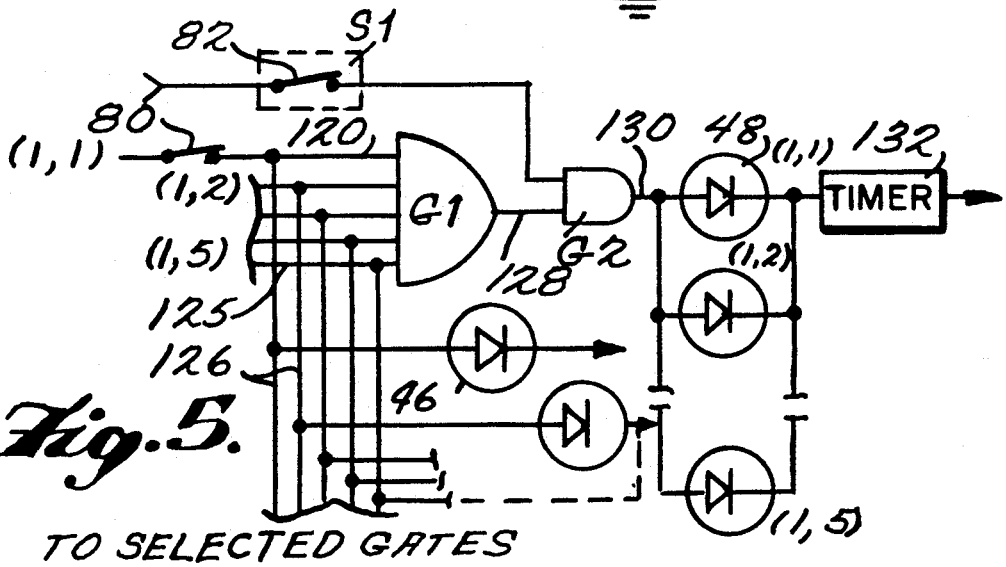
Fig. 5.

ELECTRIC BINGO GAME CARD

BACKGROUND OF THE INVENTION

The invention generally relates to a bingo game card and in particular, the invention relates to an electric bingo game card which is adapted for tracking play and indicating a winning combination for regular bingo and variations of the game.

Bingo is a popular game which is played extensively throughout the United States and other countries. The game is played utilizing a game card having an ordered set or matrix of numbered squares in a 5×5 array. Typically, the numbers 1–75 are divided into five sets of 15, namely 1–15, 16–30, 31–45, etc. Five of each set of numbers is associated with each vertical column in the matrix. The arrangement of numbers within each of the five groups is random and upwards of 45,000 different combinations or faces of a bingo card are available. During the game, numbers are called and the player marks or covers the squares with chips or some marking device.

The typical play sequence for a session of games may employ two types of game cards—rigid or hard cards and disposable specials. The hard cards may be used a number of times in a session to play regular bingo. A known hard card 10 is illustrated in FIG. 1. The card 10 has two faces 12 and 14, and accordingly is known in the trade as a 2-on card. The faces have, as noted, an ordered 5×5 array of boxes 16 containing printed numbers, as shown, in rows 18 and columns 20. The columns 20 are headed from left to right with the letters B-I-N-G-O. As numbers are called by the game operator, chips 22 are placed by the player over a called number to keep track of the game. In the board illustrated in FIG. 1, some of the numbers are shown covered by a chip 22. In FIG. 1, the third horizontal row 24 shows a winning combination of five covered boxes 16 across. The center box 26 is called a "Free Space" and requires no call to establish a winning combination. The use of chips with a hard card is inconvenient to use because the chips may shift during play, especially if an individual uses more than one bingo card.

Each card 10 has a code associated with it which indicates what face is displayed. For instance, in FIG. 1 the upper faced 12 has the code number 1115 associated with it located in the center free space 26, and the lower faced 14 has the number 1165. These numbers identify which particular combination of numbers from the 45,000 plus available combinations the face represents.

As is well known, there are at least 13 different ways to win at regular bingo including filling or covering the numbers in each of the five horizontal rows, each of the five vertical columns, the two diagonals extending from the upper right hand corner to the lower left and vice versa and the four corners. The winning combination 24 illustrated is simply one the 13 available regular bingo winners.

After a number of regular games have been played, the operator may call for one or more specials. Specials are variations of bingo in which a particular pattern of boxes on the face must be filled before a winner is declared. A typical special is an "X" pattern, requiring that both diagonals be filled before a winner is declared. Another special is the so-called "Round Robin" wherein all of the boxes about the perimeter of the face must be filled. Other variations of the game are available as specials.

Specials may be played on the hard card 10 illustrated in FIG. 1. More likely, however, the operator provides disposable sheets of faces printed on low cost paper on which the player marks the called numbers with a pen or ink marker. Ink markers are convenient but require replacement of the face sheet after each game.

In many locations, disposable faces are used exclusively for regular bingo and specials. This is because no chips are required. As a result, there are typically fewer errors made by the players, there are no chip upsets and the play is faster and thus more exciting.

The disposable faces are usually sold in sheets containing multiple faces. A sheet may have multiple columns, in some cases up to 18-on. A number of sheets may be bound in a pad for an evenings play. Each sheet is usually color-coded and may have, in addition to the face code, some other number, i.e., a serial number associated with the pad which allows the operator to keep track of the faces that have been sold in an evening.

Although the disposable sheets are more convenient for both the players and the operators, the paper cost is significant. It is estimated that, in the United States, 400,000 tons of newsprint is consumed annually in these enterprises. In addition to the cost noted above, there are significant waste disposal problems associated with such consumption. One of the advantages of disposable sheets, however, is that each sheet contains a different series of faces and thus the game is rendered more exciting.

Space constraints limit the number of standard size faces a player can follow. A practical maximum is about 18-on. Players and operators would like to increase the number of faces available for play on a sheet.

In order to alleviate the difficulties associated with hard cards and disposable sheets, various electrical game boards have been proposed which have manually actuable illuminated buttons to assist in the play of the game. Some systems are electrically connected to a master board so that the results may be quickly checked. Typically, however, the electrical games which are available are complicated, expensive, and difficult to use.

The various systems which are currently available do not in all cases eliminate the need for additional paper faces and no known system provides a means for conveniently and automatically playing regular bingo as well as the variations or specials.

SUMMARY OF THE INVENTION

The present invention is directed to an electric bingo game card which includes a first group of selectors, each selector arranged in a particular location on the card in an ordered matrix representing numbers of a bingo card face. Each selector is manually selectable for producing, when actuated, an output corresponding to the location in the matrix of the selected one of the numbers. A second group of selectors each represent at least one set of ordered locations on the face corresponding to a winning combination for each of a plurality of variations of the game. Each of said second group of selectors is manually selectable for producing, when actuated, an output corresponding to the selected variation. Logic means responsive to the first group of selectors and to the second group of selectors produces a corresponding output when predetermined ones of the first group of selectors and the second group of selectors indicate a winning combination of selected numbers for the variation. Means responsive to the logic means output produces an output corresponding to the winning combination of numbers located on the face in accordance with the selected variation. In one embodiment, illumination means at each location is responsive to the output of the corresponding one of the first selectors at the location for illuminating the numbers at the selected location. In another embodiment, the illumination means is responsive to the logic means for distinguishing the set of ordered locations selected which correspond to the winning combination. Alternatively, the illumination means may indicate selected numbers and winning combinations.

BRIEF DESCRIPTION OF THE DRAWINGS

FIG. 3 is a schematic block diagram illustrating generally the operation of the electric bingo card illustrated in FIG. 2;

FIG. 4 is an enlarged illustration of an embodiment of the invention employing two different light emitting diodes (LED) to mark called and winning combinations respectively; and FIG. 5 is an illustration of a hard wired logic circuit for a winning combination.

DETAILED DESCRIPTION OF THE PREFERRED EMBODIMENTS

Figure 1:
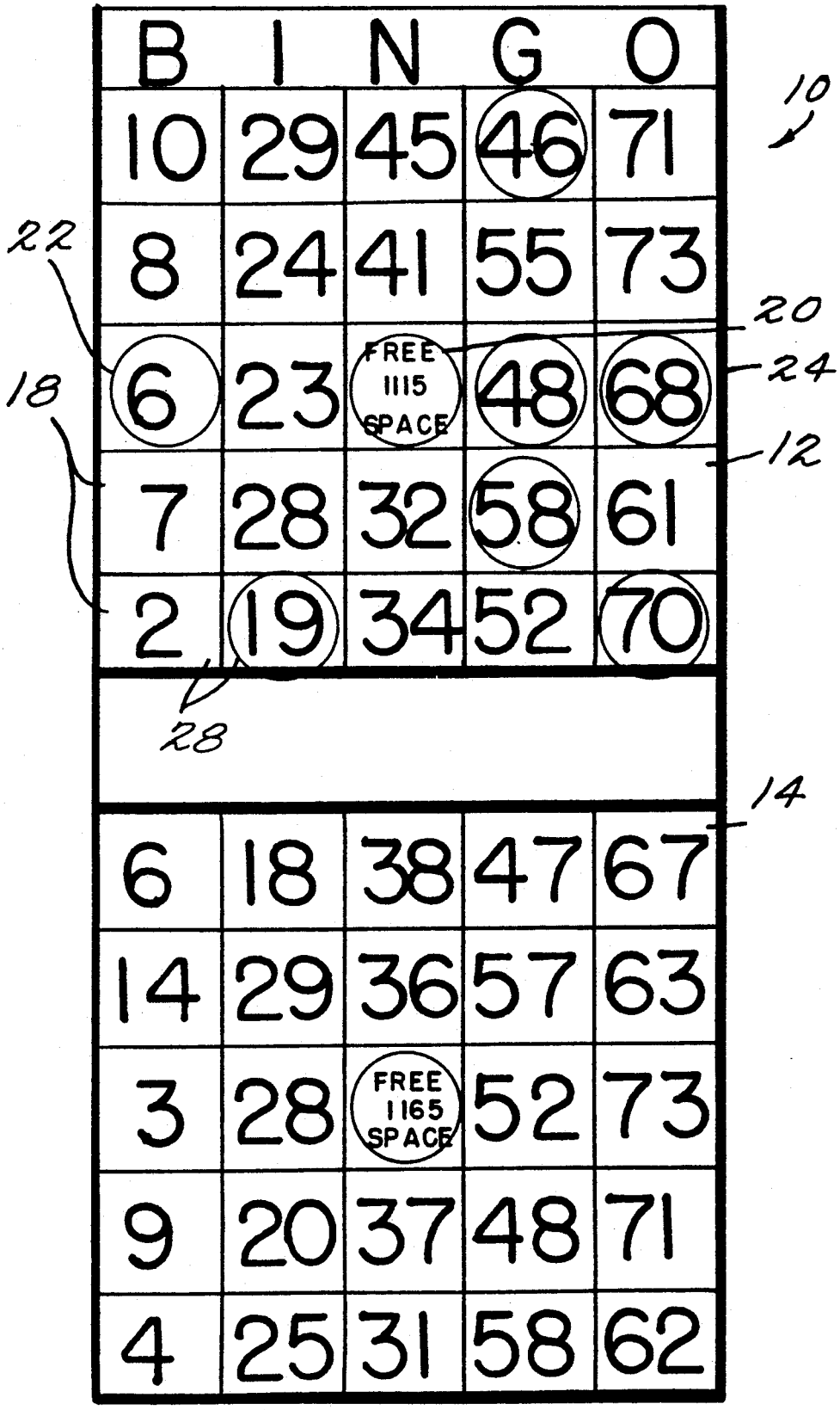
Fig. 1. (PRIOR ART)
FIG. 1 is an illustration of a typical bingo game card.
Figure 2:
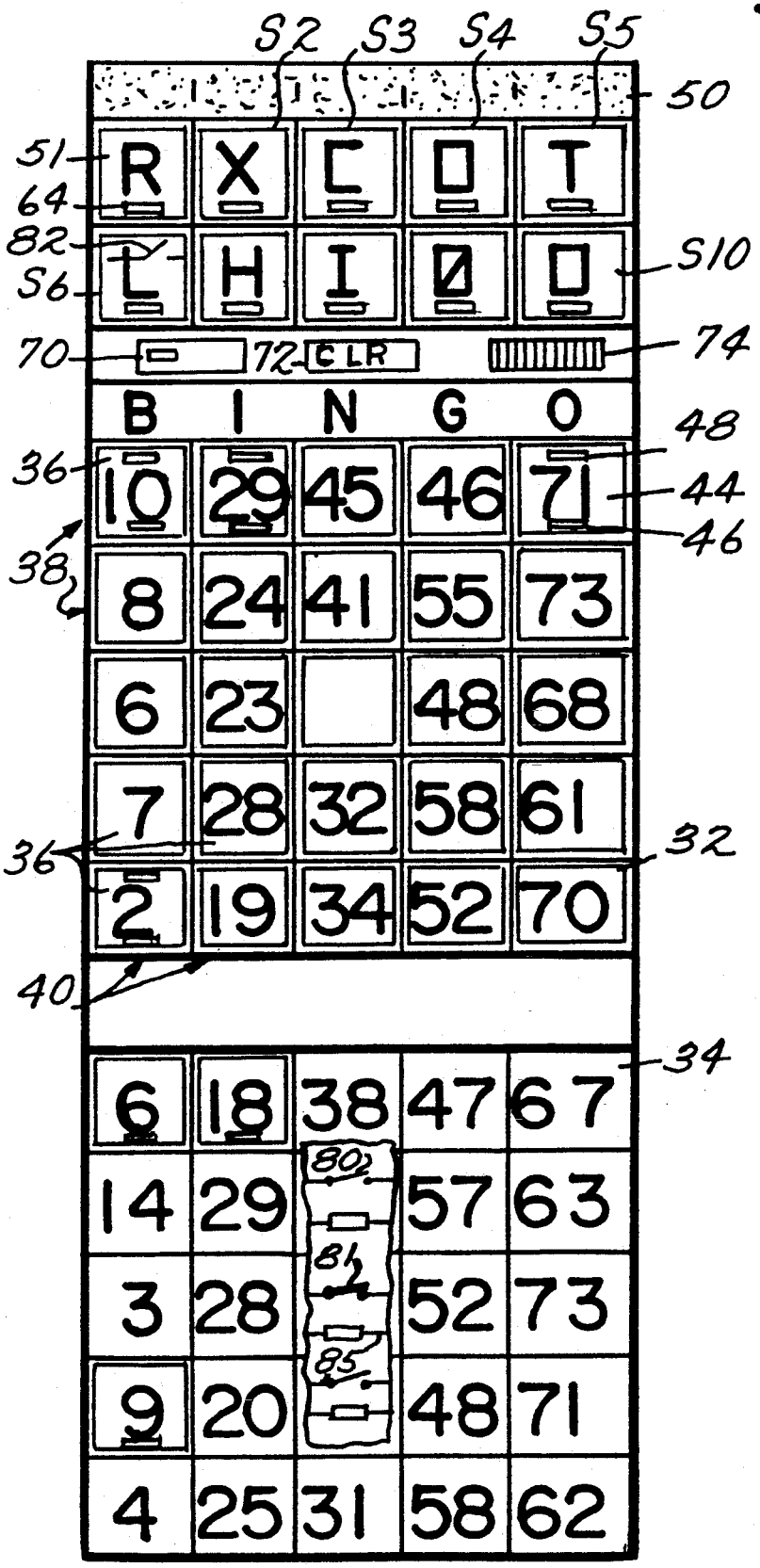
FIG. 2 is a fragmentary plan view of an electric bingo game card in accordance with one embodiment of the present invention with portions broken away.

FIG. 2 illustrates a game board 30 in accordance with the present invention. The game board is a 2-on configuration having faces 32 and 34. It should be understood that the invention also includes variations in which a single face or a greater number of faces on may be provided. In accordance with one aspect of the invention, the size of each face may be reduced so that the number of faces on may be increased over the current practical limit of 18 using standard 4"×4" faces.

As described previously, each face 32 and 34 of the game board 30 is arranged in an ordered matrix in a 5×5 array of squares 36 in horizontal rows 38 and vertical columns 40. The letters B-I-N-G-O, derived from the name of the game, are respectively located over the vertical columns 40 from left to right as illustrated. Each of the squares 36 has an indica or number associated with it, the arrangement of numbers defining the particular face. Each square 36 includes a switch actuator or button 44 forming a first set of said switch actuators which may be manually selected. Each square 36 further includes at least one, and preferably, a plurality of respective call and win illuminating means such as light emitting diodes (LED) 46 and 48. When a button 44 is actuated, one of the call illuminating means, for example LED 46, is illuminated so as to allow the player to keep track of the number which has been called. Thus, in accordance with the present invention, individual locations on the faces 32 or 34 may be illuminated by selectively depressing certain ones of the first set of buttons 44 so the player may conveniently keep track of the game. When a winning combination occurs, the win LEDs 48 are illuminated. Energy to run the game board 30 and power the LEDs may be supplied to the system by a solar cell 50 which may receive energy from ambient illumination.

In accordance with a feature of the invention, a second set of buttons 60 is conveniently provided in an upper portion of the card 30. In the arrangement illustrated, ten buttons S1, S2 . . . S10 are provided. The button S1 marked "R" may be manually selected when regular bingo is in play. The remaining buttons S2–S10 may be selected manually when variations or specials are in play. For example, button S2 marked "X" represents a special or variation requiring cross diagonals to win. Button S4 represents a round robin, and button S10 represents a full board. Other variations are illustrated by the patterns shown and do not need further explanation at this point.

An on/off switch 70 is provided for activating the game board and a clear button 72 is provided for clearing the game at the end of play. A bar code 74 may be provided to verify the card as a valid card in play, to verify a win and also for other housekeeping functions.

In accordance with an embodiment of the invention, the game board 30 includes a logic circuit, discussed hereinafter, which is responsive to the selective actuation of the first set of buttons 44 and the second set of buttons 60. When regular bingo is in play, the S1 button is depressed and illuminated by LED 64. In response to selective actuation of the face buttons 44, power is coupled to each mark LED 46 for each number called by the operator. If any one of the 13 variations of regular bingo occurs, that is if a player actuates all of the buttons 36 in a row, column, diagonal or the four corners, the logic circuit senses the combination and causes the win LEDs 48 in a particular row, column, diagonal or four corners to flash for a selected time interval thereby alerting the player of a win situation. It should be readily apparent that the player's attention will usually be alerted inasmuch as the player will be looking at the last number in a winning combination when the number is pressed and hence be alerted to a win.

At the end of a particular game, the clear button 72 is manually actuated to extinguish the call LEDs 46 and to reset the circuits.

If particular specials are called, the player may simply actuate one of the buttons S2–S10. The same sequence occurs during play, namely each player depresses a call button 36 for each of the numbers called until a winning combination occurs. In the case of the selector S2, a double diagonal or X is required to win.

As usual, in a game of bingo, upon the occurrence of a win, the player calls out and the card 30 is checked. This may be conveniently achieved by means of the bar code 74. If each individual game card 30 is identified uniquely, then the information from the bar code may be correlated with stored information with the operator to verify that the winning combination exists. The bar code can also be used to verify that the card is a valid card in play.

In the arrangement illustrated in FIG. 2, the first set of call buttons 44 are arranged in the five horizontal rows 38 labelled 1–5 beginning with the top row and the horizontal columns 40 labeled 1–5 starting with the extreme left hand column. In the upper left hand corner, the first button is designated (1,1), the first number representing the row 38 and the second number representing the column 40. The first button in the second row is labeled (2,1). All of the buttons 44 are so labeled in accordance with the scheme. The buttons 60 in the second set are labeled S1–S10. In one embodiment, each of the buttons 44 are coupled to a corresponding normally open switch contact 80. When the contact 80 for the particular switch is actuated, the corresponding call LED 46 is illuminated. When all of the buttons required for a winning combination are illuminated, the win LEDs 48 are illuminated for a selected period of time. Likewise, the buttons 60 in the second set include a switch contact 82 which, when actuated, causes the corresponding LED 64 for the particular button selected to be illuminated. In one embodiment of the invention, the switch contacts 80 and 82 may be sequential switches which means that a first actuation of the switch causes the corresponding switch contact to close and a second actuation causes the contact to open. This can thus be used to correct an improperly selected button. The switch contacts 80 and 82 may also be normally open (or closed) momentary contacts, the sequential actuation of which may be sensed by the logic circuit hereinafter described to correct for errors. The power switch 70 and clear button 72 also have contacts not shown. The card 30 includes a support 31 for carrying printed circuit traces 85 to couple the contacts to the logic circuit hereafter described.

FIG. 3 illustrates in schematic block form a logic circuit 90 coupled to the game card 30 which has one first set of call buttons 36 and a second set of variations or specials buttons 60. It should be understood that multiple faces may be employed and only one is shown in order to simplify the discussion.

In the arrangement illustrated in FIG. 3, each of the switches 80 and 82 as well as the power 70 and clear buttons 72 are coupled to a microprocessor one bus 98 via a latching circuit 94. In at least one embodiment of the invention, the latching circuit 94 is optional if switches are employed whereby signal is maintained between the game board 30 and the microprocessor 92. A read only memory (ROM) 96 stores data corresponding to the location of the buttons 36 and 60 on each of the faces 32, 34, etc. on the game card 30 indicative of all of the winning combinations for regular bingo as well as the specials. When the particular variations selected by the game variations switches 60 and individual call switches 36 are actuated, the processor 92, utilizing stored information from the ROM 92, processes the data until a winning combination is sensed whereupon a win indication is provided. The game board 30, the microprocessor 92, the latch 94 and the ROM 96 are coupled by interconnecting bus 98, as illustrated. The microprocessor 92 may be suitably programmed to initiate illumination of the call LEDs 46 upon actuation, and the win LEDs 48 upon sensing a winning combination. Indication signals may be coupled from the microprocessor 92 to the game board 30 over return bus 100. Power is supplied to the game board and the microprocessor and the other circuits by means of the solar cell 50 when the on/off switch 70 is closed as indicated. A keep alive battery 102 may be employed to maintain the microprocessor data and the last win in case of a inadvertent clear of the game or a inadvertent shut off is switch 70 is open.

The ROM 96 may be a staic or dynamic memory. It may also be more versatile such as any one of a variety of such devices available to those skilled in the art including a so-called programmable read only memory (PROM) and an erasable programmable read only memory (EPROM) as well as other similar devices capable of storing data. For purposes of discussion, it is assumed that the ROM 96 may be programmed in the factory prior to assembly of the game board 30 or it may be programmed by the operator over an input line 104 which also may be coupled to the microprocessor 92.

In accordance with one embodiment of the invention illustrated in FIG. 4, each of the boxes 36 has a permanent mark indication or indica 106 which is the number assigned to the particular location on the face 32, 34, etc. As illustrated, the call LED 46 and the win LED 48 are located respectively below and above the indica 106. Alternatively, the indica 106 may be back lit by a low power lamp or LED (not shown). Also, in accordance with the invention, a single LED may be employed for both call and win purposes. By appropriate programming of the microprocessor 92, manual actuation of the switch contacts 80 will cause the LED 46 to be illuminated. LEDs 48 may be a different color from LEDs 46 and distinguish a win. If desired, when a winning combination sensed by the microprocessor 52, selected ones of the actuated call LEDs 46 may be flashed to indicate a win. The microprocessor likewise may control an appropriate timer to accomplish flashing function.

A simplified logic hard wired logic circuit 110 is illustrated in FIG. 5. The circuit 110 shows in a simplified form an embodiment of the invention in which hard wired circuits perform the logic function without the necessity of a microprocessor 92 or memory device 96. As each of the call buttons 44 is actuated at locations (1,1) . . . (1,5), the corresponding contacts are closed while the call LEDs 46 are illuminated over the interconnected wires 126 as illustrated. In the arrangement illustrated, it is assumed that the selector switch S1 has been actuated and switch 82 is mechanically or electrically latched closed. In order to logically sense a winning combination, a first AND gate G1 having five inputs 120–125 is employed. The inputs are coupled to switch contacts 80 corresponding to the select switches 36 in the upper row of FIG. 2, that is, for the buttons (1,1), (1,2) . . . (1,5). When each of the switches 80 is latched closed, the AND gate G1 produces an output on line 128. The regular bingo select switch S1 is coupled over contacts 82 to a second AND gate G2 over input 127. The output 126 of G1 and the input 127 from select switch 82 are coupled to the AND gate G2 which produces an output or line 130 for illuminating the win LEDs 48 in each of the locations (1,1,) (1,2) . . . (1,5). Timer 132 in circuit with LEDs 48 is responsive to the AND gate G2 to flash the LED 48.

A corresponding set of first and second AND gates (not shown) may be employed for each remaining winning combination of regular bingo. Likewise, a corresponding set of AND gates (not shown) may be employed for each winning combination associated with the remaining specials and switches S2–S10. It should be readily apparent to those skilled in the art that in order to avoid redundancy or undue cost, some of the inputs and the outputs may be coupled together when appropriate.

In order to generally illustrate the invention, the table below has been developed to show the winning combinations for the 13 variations of regular bingo and 7 variations or specials. The first column in the table represents the game under way. The games include regular bingo (R) or any one of the specials such as X, C, round robin (D), the shapes or letters I, L, T, H, full/2, (half board coverage) and full (full board coverage). The 13 variations of regular bingo are illustrated by means of the designation 1–13 following the letter R. The second column shows the call buttons or selectors from the first set of actuators required to establish a win for each of the selected variations. The third column indicates the variation selector from the second set of buttons 60 required for a win in the game. For example, a first row win in regular bingo requires actuation the all the switches 44 in the first row namely (1,1), (1,2) . . . (1,5) and the actuation of the variation selector S1 shown in the third column. The call selectors for the remaining variations are R2–R13 are shown.

The specials are designated by the type of game or pattern in the particular special under way. For example, the double diagonal or X is shown in the first column. In order to win the X variation, it is necessary for all of the call selectors and the diagonals to have been depressed. The table has been simplified by indicating that the call selectors for R12 and R13 versions of regular bingo, namely the left and right diagonal, must be selected in combination with the S2 button for a winning indication in the X special. Likewise, the other specials refer to the regular bingo variations for simplicity and incorporate the call selectors by reference thereto. The full/2 or half board variation calls for the respective top and left hand row and column R1 and R6 plus particular buttons required to fill in half the board.

If desired, the system may include built in variations of the specials. For example, the C variation requires the top row (R1), the bottom row (R5) and the left hand column (R6) to be filled. If desired, the C special may allow a winner win any three of the top and bottom row and left and right columns are full. In other words, a backward C, and a U or an inverted U may also be winners if desired. Likewise, E, L, T, H and full/2 may also allow winners in any orientation symmetrical about the center of the face.

| Game | Call Selectors | Variable Selector |
|---|---|---|
| R1 | 1,1 1,2 1,3 1,4 1,5 | S1 |
| R2 | 2,1 2,2 2,3 2,4 2,5 | S1 |
| R3 | 3,1 3,2 3,3 3,4 3,5 | S1 |
| R4 | 4,1 4,2 4,3 4,4 4,5 | S1 |
| R5 | 5,1 5,2 5,3 5,4 5,5 | S1 |
| R6 | 1,1 2,1 3,1 4,1 5,1 | S1 |
| R7 | 1,2 2,2 3,2 4,2 5,2 | S1 |
| R8 | 1,3 2,3 3,3 4,3 5,3 | S1 |
| R9 | 1,4 2,4 3,4 4,4 5,4 | S1 |
| R10 | 1,5 2,5 3,5 4,5 5,5 | S1 |
| R11 | 1,1 2,2 3,3 4,4 5,5 | S1 |
| R12 | 1,5 2,4 3,3 4,2 5,1 | S1 |
| R13 | 1,1 1,5 3,3 5,1 5,5 | S1 |
| X | R11 R12 | S2 |
| C | R1 +R5 +R6 | S3 |
| D | R1 +R5 +R6 +R10 | S4 |
| E | R1 +R3 +R5 +R6 | S5 |
| L | R5 +R10 | S6 |
| T | R1 +R8 | S7 |
| H | R3 +R6 +R10 | S8 |
| Full | R1 +R6 +2,2 2,3 2,4 | S9 |
| 2 | 3,2 3,3 4,2 | |
| Full | R1 R2 R3 R4 R5 | S10 |

While there has been described what at present are considered to be the preferred embodiments of the present invention, it will be readily apparent to those skilled in the art that various changes and modifications may be made therein without departing from the invention and it is intended in the appended claims to cover such changes and modifications as fall within the true spirit and scope of the invention.

What is claimed is:

1. A hand held portable electric bingo game card comprising:

a first group of selector means;

an ordered matrix of predetermined unalterable numbers representing a corresponding predetermined bingo card face affixed to a surface of said electric bingo game card, individual ones of the first group of selector means being positioned on the card in the matrix adjacent a corresponding number of each of said predetermined unalterable numbers on the face, said selector means being manually selectable when the corresponding number is called for producing, when actuated, an output corresponding to the location on the face of the called number;

a second group of selector means each representing variation of bingo corresponding to a pattern of number locations on the face required to be called in order to win the game and being manually selectable for producing, when actuated, an output corresponding to a selected one of said variations of bingo;

logic means responsive to selected ones of said first group of selector means and to a selected one of the second group of selector means for producing a corresponding logic output when predetermined ones of the first group of selector means and one of said second selector means indicate a winning combination of the numbers in the pattern required to win;

illumination means being responsive to the first group of selector means and being energized for illuminating individual locations in the matrix of numbers called during play in response to the actuation of the corresponding selector means to a first condition and being deenergized upon actuation of said selector means to a second condition without resetting the first and second groups of selector means, the logic means and the illuminating means, and being further responsive to the logic output for illuminating the location in the matrix of the winning combination of numbers in accordance with the selected variation so that a player may readily ascertain that the winning combination has been called; and reset means for resetting when actuated the first and second groups of selector means, the logic means and the illuminating means.

2. The electric bingo game card of claim 1, further comprising support means for supporting the first and second group of selector means, the illumination means and the logic means, said game card further including printed circuit means on the support means for selectively interconnecting elements supported thereon.

3. The electric bingo game card of claim 1, further comprising at least one source of power coupled in circuit with the elements on the support means.

4. The electric bingo game card of claim 3, wherein the source of power includes at least one of a solar cell and keep alive battery.

5. The electric bingo game card of claim 1, wherein the logic means comprises gate means responsive to selected ones of the first group of selector means and at least one of said second group of selector means for producing an output when inputs to the gate means indicate a winning combination.

6. The electric bingo game card of claim 5, further comprising timer means coupled to the illumination means for extinguishing the illumination means after a selected interval subsequent to initial illumination.

7. The electric bingo game card of claim 1, wherein said illumination means includes a first indicator and a second indicator, for each first selector means, said first indicator for indicating a called number, and said second indicator for indicating a selection in a winning combination.

8. The electric bingo game card of claim 7, wherein the timer means further includes means for periodically energizing the second indicator means during the timed interval rendering said second indicator means readily noticeable to a human bingo game player.

9. The electric bingo game card of claim 1, further comprising reset means coupled to the logic means for resetting the illumination means subsequent to the completion of a game.

10. The electric bingo game card of claim 1, further comprising encoding means formed on the board identifying the bingo card face as valid.

11. The electric bingo game card of claim 10, wherein the encoding means includes a bar code.

12. The electric bingo game card of claim 1, wherein the illumination means comprises light emitting diodes.

13. The electric bingo game card of claim 1, wherein the logic means comprises a microprocessor programmed to recognize a winning combination of selected first and second selection means.

14. A method of operating a hand held portable electric bingo card comprising the steps of:

selecting and deselecting predetermined unalterable indicia affixed to a surface of said electric bingo game card from at least one first group of selector means in an ordered matrix of predetermined unalterable indicia representing a bingo card face; illuminating and extinguishing each indica in accordance with said selection and deselection, respectively;

selecting at least one of a second group of selector means each representing variations of bingo;

logically distinguishing respective ones of the first selected group of selector means and the second group of selector means and producing an indication of a winning combination in accordance with the selected variation;

illuminating the winning combination so as to render the said combination noticeable by a human player in response to such logical distinction;

extinguishing the indication of a combination in the event of a deselection of any one of at least said first selector means; and maintaining the selections and deselections made as they occur so as to allow for correction thereof without cancelling otherwise correct indications, whereby the status of the bingo card may be readily determined without repeating selections made.

15. A hand held portable electric bingo game card having at least one bingo card face per card thereon comprising:

a first group of individual selector means;

an ordered matrix of predetermined unalterable indica representing for each bingo card face a substantially unique arrangement of such indica affixed to a surface of said electric bingo game card individual ones of the first group of selector means being positioned in the matrix adjacent a corresponding indica of each of said predetermined unalterable indica by on the face, said selector means being manually selectable and deselectable for producing, when selected, the first output corresponding to the location on the face of the selected indica and producing a second output corresponding to the location on the face of the deselected indica;

a second group of selector means each representing a variation of bingo corresponding to a pattern of indica locations on the face required to be called in order to win a game and being manually selectable for producing, when actuated, an output corresponding to a selected one of said variations of bingo;

logic means responsive to selected ones of said first group of selector means and to a selected one of the second group of selector means for producing an output when predetermined ones of the first group of selector means and one of said second selector means indicate a winning combination of the indica in the pattern required to win;

illumination means responsive to the logic means output for illuminating the location in the matrix of the winning combination of indica in accordance with the selected variation so that a player may readily ascertain that the winning combination has been called; and reset means operative only when actuated to cancel selections made and to extinguish the illumination means, said first and second groups of individual selector means being selectable and deselectable independently of the reset means whereby correction of said selector means may be made at any time prior to actuation of the reset means.

* * * * *